US010348021B2

(12) United States Patent
Moss et al.

(10) Patent No.: US 10,348,021 B2
(45) Date of Patent: Jul. 9, 2019

(54) LOCK FOR AN EXPLOSION PROOF CONNECTOR

(71) Applicant: RD SCAN HOLDINGS INC., Bonnyville (CA)

(72) Inventors: Ian Thomas Moss, Sherwood Park (CA); Timothy Dayn Rogers, Sherwood Park (CA)

(73) Assignee: RD Scan Holdings Inc., Bonnyville, Alberta (CA)

( * ) Notice: Subject to any disclaimer, the term of this patent is extended or adjusted under 35 U.S.C. 154(b) by 0 days.

(21) Appl. No.: 15/827,628

(22) Filed: Nov. 30, 2017

(65) Prior Publication Data

US 2018/0159261 A1 Jun. 7, 2018

(30) Foreign Application Priority Data

Dec. 2, 2016 (CA) ..... 2950368

(51) Int. Cl.
*H01R 13/434* (2006.01)
*H01R 13/527* (2006.01)
(Continued)

(52) U.S. Cl.
CPC ..... *H01R 13/434* (2013.01); *H01R 13/527* (2013.01); *H01R 13/6395* (2013.01);
(Continued)

(58) Field of Classification Search
CPC .. H01R 13/434; H01R 13/527; H01R 13/622; H01R 13/639; H01R 13/59; H01R 13/6395; H01R 13/6397; H01R 13/533
(Continued)

(56) References Cited

U.S. PATENT DOCUMENTS 2,784,385 A 3/1957 Ennis
3,537,065 A 10/1970 Winston
(Continued)

FOREIGN PATENT DOCUMENTS

CA 2416484 A1 1/2003

OTHER PUBLICATIONS

Amphenol Corporation "Amphenol Pyle MIL-C-26500 Connectors" Retrieved Jun. 23, 2016.

*Primary Examiner* — Travis S Chambers
(74) *Attorney, Agent, or Firm* — Davis & Bujold PLLC; Michael J. Bujold

(57) ABSTRACT

An explosion proof connector is provided with first and second electrical connectors and first and second threaded sidewalls that surround the electrical connectors. The threaded sidewalls engage to secure the electrical connectors in electrical connection. Either the first threaded sidewall is rotatable relative to the first electrical connector or the second threaded sidewall is rotatable relative to the second electrical connector. A ratchet lock is carried by the first sidewall, and a ratchet surface is carried by the second sidewall, the ratchet lock being releasable and biased toward engagement with the ratchet surface. The ratchet lock permits rotation of the second sidewall relative to the first sidewall in a first direction and prevents rotation of the second sidewall relative to the first sidewall in a second direction. A release mechanism disengages the ratchet lock and permits the second sidewall to rotate in the second direction relative to the first sidewall.

13 Claims, 8 Drawing Sheets

(51) Int. Cl.

| | |
|---|---|
| ***H01R 13/639*** | (2006.01) |
| *H01R 13/59* | (2006.01) |
| *H01R 13/622* | (2006.01) |
| *H01R 13/533* | (2006.01) |

(52) U.S. Cl.
CPC ..... *H01R 13/6397* (2013.01); *H01R 13/533* (2013.01); *H01R 13/59* (2013.01); *H01R 13/622* (2013.01)

(58) Field of Classification Search
USPC ..... 439/321
See application file for complete search history.

(56) References Cited

U.S. PATENT DOCUMENTS

| | | | | |
|---|---|---|---|---|
| 3,784,966 | A | | 1/1974 | Clark |
| 3,971,614 | A | | 7/1976 | Paoli et al. |
| 4,030,798 | A | | 6/1977 | Paoli |
| 4,109,990 | A | | 8/1978 | Waldron et al. |
| 4,472,013 | A | | 9/1984 | Frear |
| 4,484,790 | A | | 11/1984 | Schildkraut et al. |
| 4,487,470 | A | | 12/1984 | Knapp et al. |
| 4,500,154 | A | * | 2/1985 | Collins ..... H01R 13/622 439/313 |
| 4,508,408 | A | | 4/1985 | Shepler et al. |
| 4,519,661 | A | | 5/1985 | Brush, Sr. et al. |
| 4,588,246 | A | | 5/1986 | Schildkraut et al. |
| 4,641,811 | A | | 2/1987 | Gallusser et al. |
| 4,726,782 | A | | 2/1988 | Hager et al. |
| 4,746,303 | A | | 5/1988 | Cobraiville et al. |
| 4,808,117 | A | * | 2/1989 | Gale ..... F16L 25/01 439/192 |
| 4,984,995 | A | | 1/1991 | Tucker et al. |
| 5,145,394 | A | | 9/1992 | Hager |
| 5,496,189 | A | * | 3/1996 | Over ..... H01R 13/622 439/321 |
| 5,718,831 | A | * | 2/1998 | Zigliotto ..... H01R 13/622 219/121.39 |
| 6,152,753 | A | | 11/2000 | Johnson et al. |
| 7,134,894 | B2 | * | 11/2006 | Murphy ..... H01R 9/05 439/307 |
| 8,696,374 | B2 | * | 4/2014 | Oe ..... B60L 11/1816 439/321 |
| 9,099,807 | B2 | | 8/2015 | Opgenorth |
| 2014/0167408 | A1 | | 6/2014 | Steen et al. |

* cited by examiner

LOCK FOR AN EXPLOSION PROOF CONNECTOR

TECHNICAL FIELD

This relates generally to a lock for an electrical connector, and in particular, a lock that prevents accidental release of the electrical connector.

BACKGROUND

The use of electrically powered equipment on dangerous worksites carries a risk of explosion due to sparks generated when electrical connections are formed or decoupled. In order to reduce the risk of flammable gases or other ambient substances being ignited, connectors are provided that resist decoupling. One example of such a connector is found in U.S. Pat. No. 4,109,990, which teaches a connector that resists decoupling.

SUMMARY

According to an aspect, there is provided an explosion proof connector comprising a first electrical connector and a second electrical connector, a first threaded sidewall that surrounds the first electrical connector and a second threaded sidewall that surrounds the second electrical connector, the first and second threaded sidewalls threadably engaging to secure the first and second electrical connectors in electrical connection, wherein either the first threaded sidewall is rotatable relative to the first electrical connector or the second threaded sidewall is rotatable relative to the second electrical connector, a ratchet lock carried by the first threaded sidewall, a ratchet surface carried by the second threaded sidewall, the ratchet lock releasably engaging the ratchet surface, the ratchet lock being biased toward engagement with the ratchet surface such that the ratchet lock permits rotation of the second threaded sidewall relative to the first threaded sidewall in a first rotational direction, and prevents rotation of the second threaded sidewall relative to the first threaded sidewall in a second rotational direction, and a release mechanism that disengages the ratchet lock from the ratchet surface to permit the second threaded sidewall to rotate in the second rotational direction relative to the first threaded sidewall.

According to another aspect, the release mechanism may be actuated by a release tool that is manually engaged with the ratchet lock to disengage the ratchet lock from the ratchet surface.

According to another aspect, the first threaded sidewall may be an externally threaded sidewall, and the second threaded sidewall may be an internally threaded sidewall.

According to another aspect, the second threaded sidewall may be rotatable relative to the second electrical connector.

According to another aspect, the ratchet lock may be pivotally mounted about a pivot axis and may comprise a locking surface on a first side of the pivot axis and a release surface on a second side of the pivot axis, wherein the locking surface moves away from the ratchet surface as the release surface is moved toward the ratchet surface.

According to an aspect, there is provided a lock for an electrical connection formed by first and second electrical connectors, the first and second electrical connectors having complementary threaded sidewalls that threadably engage, the lock comprising a first sleeve having an attachment that attaches to the first electrical connector, the first sleeve carrying a ratchet lock on an interior surface, the interior surface defining a cavity, a second sleeve having an attachment that attaches to the second electrical connector, the second sleeve having a ratchet surface on an exterior surface at a first end of the second sleeve, the first end of the second sleeve being sized to fit within the cavity of the first sleeve, wherein, when the first and second electrical connectors are threadably engaged, the first end of the second sleeve is inserted into the cavity of the first sleeve and the ratchet lock releasably engages the ratchet surface, the ratchet lock being biased toward engagement with the ratchet surface such that the ratchet lock permits the first and second electrical connectors to threadably engage and prevents the first and second electrical connectors from being threadably released, and a release mechanism that disengages the ratchet lock from the ratchet surface to permit the first and second electrical connectors to be threadably released.

According to another aspect, the release mechanism may be actuated by a release tool that is manually engaged with the ratchet lock to disengage the ratchet lock from the ratchet surface.

According to another aspect, the ratchet lock may be pivotally mounted about a pivot axis and comprise a locking surface on a first side of the pivot axis and a release surface on a second side of the pivot axis, wherein the locking surface moves away from the ratchet surface as the release surface is moved toward the ratchet surface.

According to an aspect, there is provided a method of forming an explosion proof connection, the method comprising the steps of providing an explosion proof connector comprising a first electrical connector and a second electrical connector, a first threaded sidewall that surrounds the first electrical connector and a second threaded sidewall that surrounds the second electrical connector, wherein either the first threaded sidewall is rotatable relative to the first electrical connector or the second threaded sidewall is rotatable relative to the second electrical connector, a ratchet lock carried by the first threaded sidewall, a ratchet surface carried by the second threaded sidewall, the ratchet lock being biased toward engagement with the ratchet surface, and a release mechanism, and threadably engaging the first and second threaded sidewalls to secure the first and second electrical connectors in electrical connection by rotating the second threaded sidewall relative to the first threaded sidewall in a first rotational direction, the ratchet lock engaging the ratchet surface to prevent rotation of the second threaded sidewall relative to the first threaded sidewall in a second rotational direction.

According to another aspect, the method may further comprise the steps of actuating the release mechanism to disengage the ratchet lock from the ratchet surface to permit the second threaded sidewall to rotate in the second rotational direction relative to the first threaded sidewall, threadably disengaging the first and second threaded sidewalls to release the first and second electrical connectors by rotating the second threaded sidewall relative to the first threaded sidewall in the second rotational direction, and disconnecting the explosion proof connection.

According to another aspect, actuating the release mechanism may comprise manually engaging a release tool with the ratchet lock to disengage the ratchet lock from the ratchet surface.

According to another aspect, the first threaded sidewall may be an externally threaded sidewall, and the second threaded sidewall is an internally threaded sidewall.

According to another aspect, the second threaded sidewall may be rotatable relative to the second electrical connector.

According to another aspect, the ratchet lock may be pivotally mounted about a pivot axis and may comprise a locking surface on a first side of the pivot axis and a release surface on a second side of the pivot axis, wherein the locking surface moves away from the ratchet surface as the release surface is moved toward the ratchet surface.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
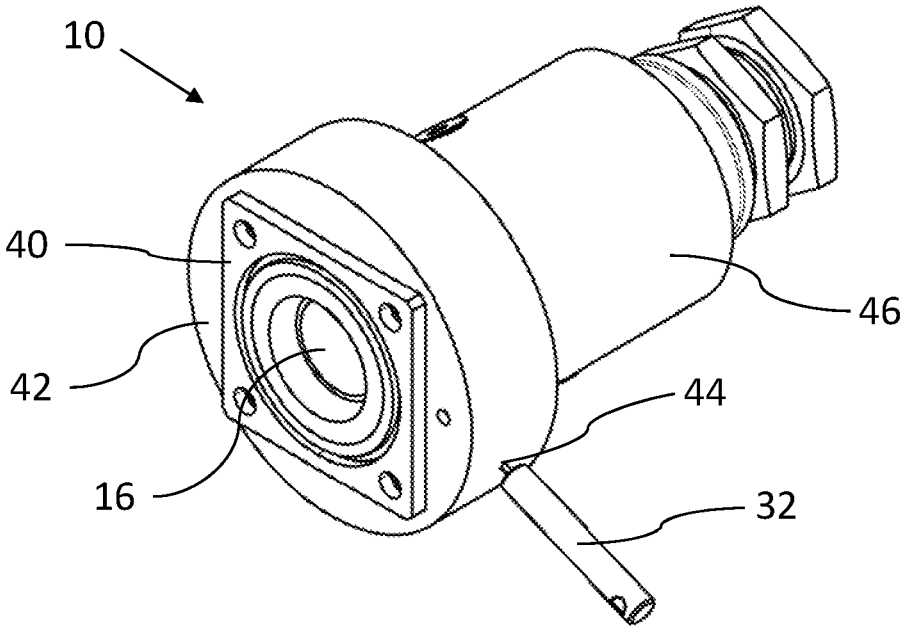
FIG. 1 is a front perspective view of an explosion proof connector.

An explosion proof connector generally identified by reference numeral 10, will now be described with reference to FIG. 1 through 15.

Figure 7:
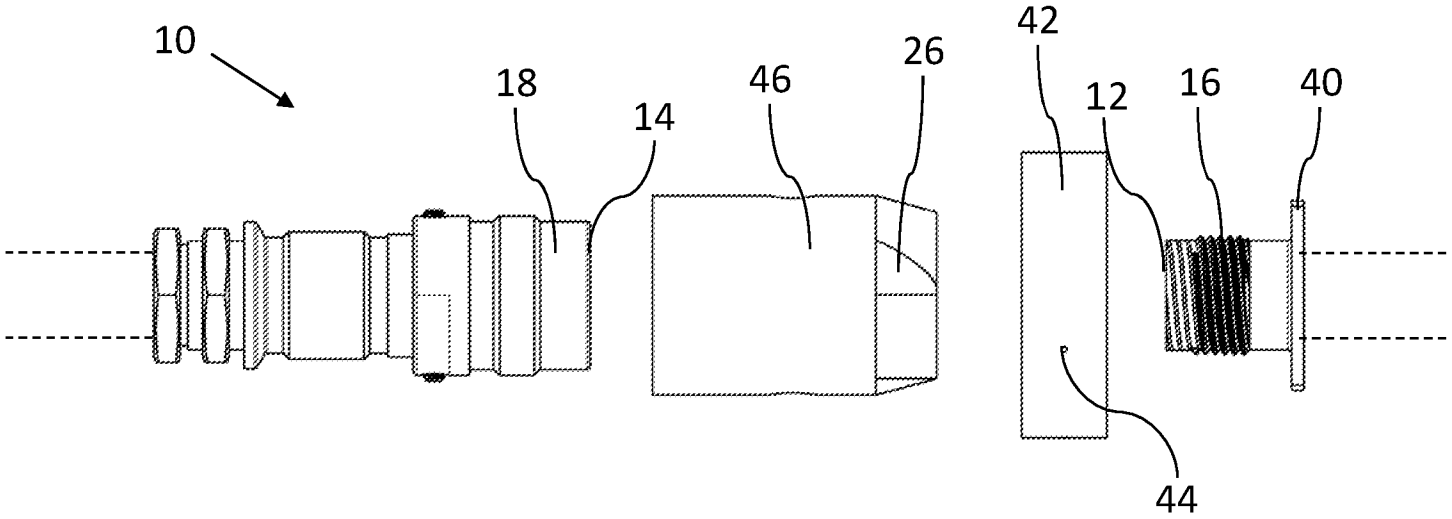
FIG. 7 is an exploded side elevation view of the connector of FIG. 1.
Figure 9:
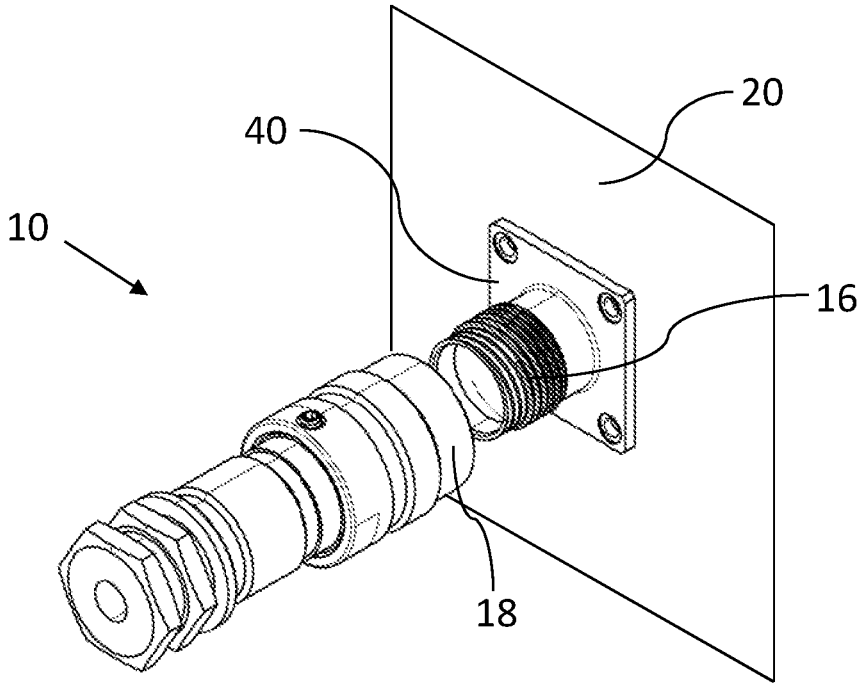
FIG. 9 is a perspective view of the connector of FIG. 1 with the components disconnected and the ratchet sleeve and ring not shown.
Figure 10:
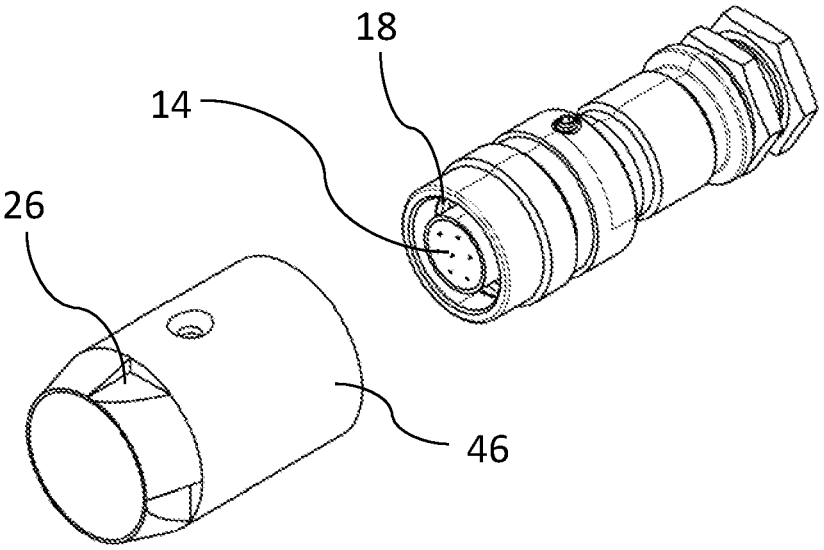
FIG. 10 is an exploded perspective view of an internally threaded component of the connector of FIG. 1.
Figure 11:
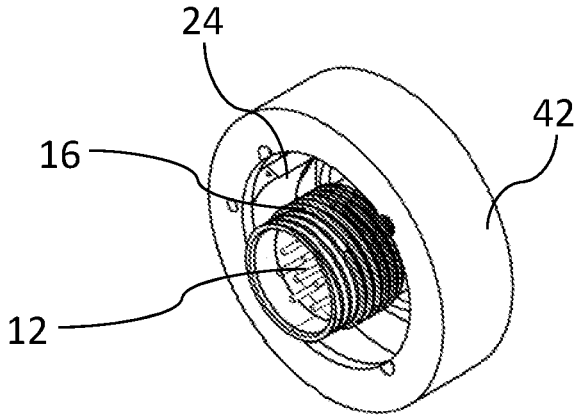
FIG. 11 is a perspective view of an externally threaded component of the connector of FIG. 1.
Figure 12:
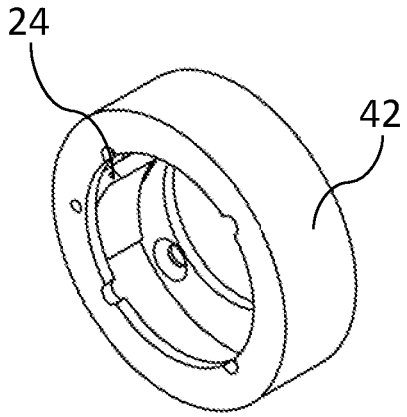
FIG. 12 is a perspective view of a ring shroud for the connector of FIG. 1.

Referring to FIG. 7, explosion proof connector 10 has a first electrical connector 12 and a second electrical connector 14. Referring to FIG. 12, first electrical connector 12 has a first threaded sidewall 16 that surrounds first electrical connector 12, and referring to FIG. 10, second electrical connector 14 has a second threaded sidewall 18 that surrounds second electrical connector 14. As shown in FIG. 11, first threaded sidewall 16 is an externally threaded sidewall, and first electrical connector 12 is intended to be an end connection in a distributed electrical system. For example, electrical connector 12 may be installed in a surface, such as a wall 20 as shown in FIG. 9, or may be mounted on an electrical device, such as a motor, generator, lighting system, etc. As shown in FIG. 10, second threaded sidewall 18 is an internally threaded sidewall, and second electrical connector 14 is intended to be mounted at the end of an electrical cable to be connected to electrical connector 12. For example, electrical connector 14 may be carried by an electrical cable of a tool or other portable appliance (not shown) to be powered, or may be connected to a generator and used to distribute electrical power. It will be understood that the actual use and design of connector may vary depending on the preferences of the user. For example, the roles of first and second electrical connectors 12 and 14 may be reversed, and one or both may be mounted to either a movable cable or a fixed structure or device. Furthermore, the male/female threaded surfaces and electrical connections may be provided to either first or second electrical connector 12 or 14 to suit the preferences of the user or demands of a system.

Figure 8:
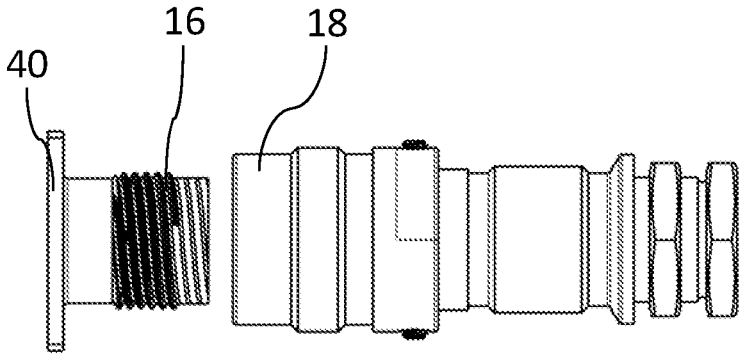
FIG. 8 is a side elevation view of the connector of FIG. 1 with the components disconnected and the ratchet sleeve and ring not shown.
Figure 15:
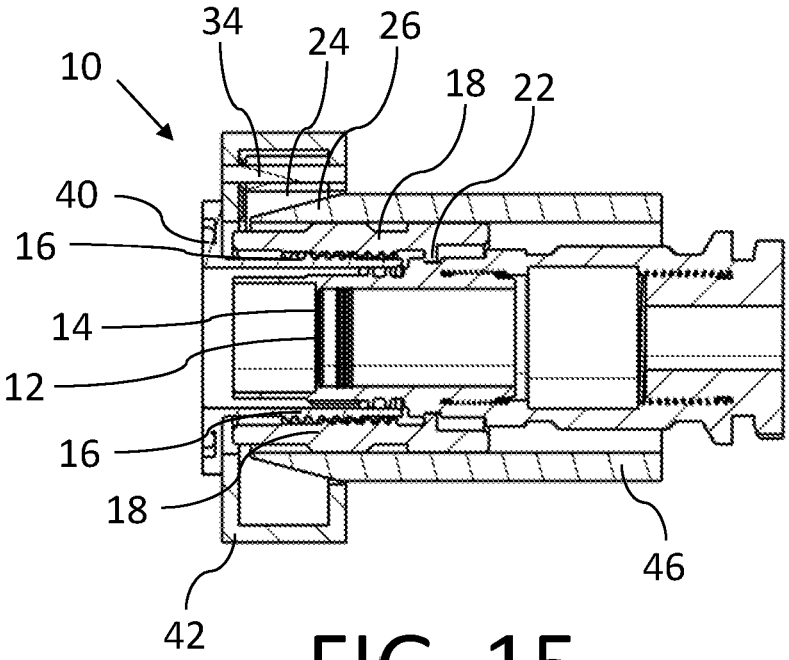
FIG. 15 is a cross sectional view of the connector of FIG. 1 taken along the line C-C of FIG. 14.

As shown in FIG. 8, first and second threaded sidewalls 16 and 18 are threadably engaged to secure first and second electrical connectors 12 and 14 to provide an electrical connection. As shown in FIG. 10 and FIG. 11, first and second electrical connectors 12 and 14 may be a plug and socket connector having pins, however, other types of electrical connectors may also be used, such as conventional power plugs. One of the sidewalls 16 or 18 is rotatable relative to the corresponding electrical connector 12 or 14. In the embodiment shown, second threaded sidewall 18 is rotatable relative to second electrical connector 14. Referring to FIG. 15, second threaded sidewall 18 is shown with a bearing surface 22 between second threaded sidewall 18 and second electrical connector 14. It will be understood that first threaded sidewall 16 may instead be rotatable relative to first electrical connector 12.

Figure 5:
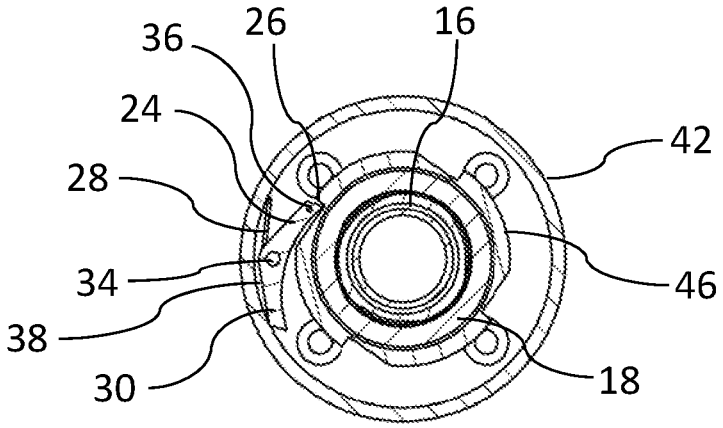
FIG. 5 is a cross-sectional view of the connector of FIG. 1, shown along the line A-A of FIG. 3, in a locked position.
Figure 6:
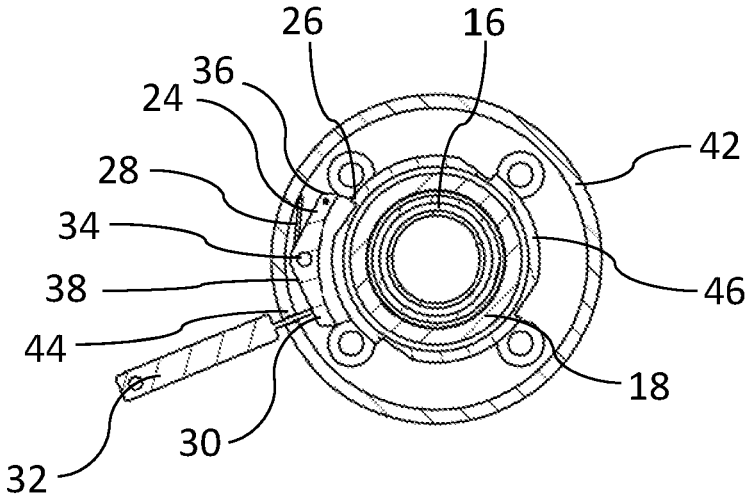
FIG. 6 is a cross-sectional view of the connector of FIG. 1, shown along the line A-A of FIG. 3, in a released position.

Referring to FIG. 5, a ratchet lock 24 is carried by first threaded sidewall 16, and a corresponding ratchet surface 26 is carried by second threaded sidewall 18. As shown in FIG. 5, ratchet lock 24 engages ratchet surface 26 to prevent rotation in one rotational direction. As first threaded sidewall 16 and second threaded sidewall 18 are threaded together, second threaded sidewall 18 is permitted to rotate relative to first threaded sidewall 16 in a first rotational direction, corresponding to the direction of rotation that causes the sidewalls to move together and the electrical connection between first and second electrical connectors 12 and 14 to be formed. However, due to the engagement of ratchet lock 24 with ratchet surface 26, rotation of second threaded sidewall 18 relative to first threaded sidewall 16 is prevented in a second rotational direction, corresponding to the separation of first threaded sidewall 16 and second threaded sidewall 18 and the disconnection of first and second electrical connectors 12 and 14. Ratchet lock 24 is biased toward engagement with ratchet surface 26, such as by a spring 28, and is releasable. As shown in FIG. 5, the ratchet component is pivotally mounted about a pivot axis 34 and a locking surface 36 is on a first side of pivot axis 34 to provide ratchet lock 24, and a release surface 38 is on a second side of pivot axis 34 to provide release mechanism 32. As shown in FIG. 6, locking surface 36 moves away from ratchet surface 26 as release surface 38 is moved toward ratchet surface 26. It will be understood that other designs may be used for ratchet lock 24 and release mechanism 30 as is known in the art. As shown in FIG. 6, a release mechanism 30 is actuated to disengage ratchet lock 24 from ratchet surface 26, permitting second threaded sidewall 18 to rotate in the second rotational direction relative to first threaded sidewall 16. This allows the first and second threaded sidewalls 16 and 18 to be disengaged, and the first and second electrical connectors 12 and 14 to be disconnected from each other, breaking the electrical connection. As shown in FIG. 6, release mechanism 30 is actuated by a release tool 32 that is manually engaged with ratchet lock 24 to disengage ratchet lock 24 from ratchet surface 26.

Figure 2:
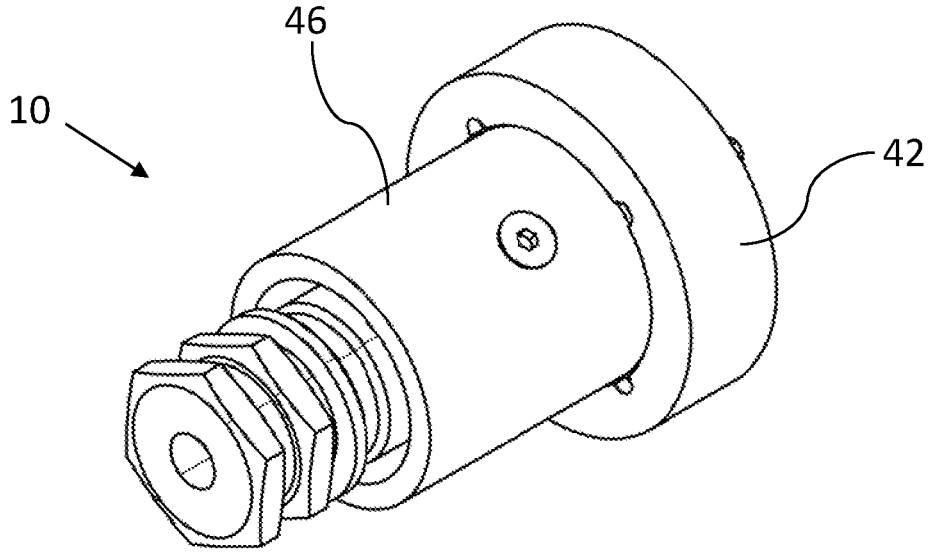
FIG. 2 is a rear perspective view of the connector of FIG. 1.
Figure 3:
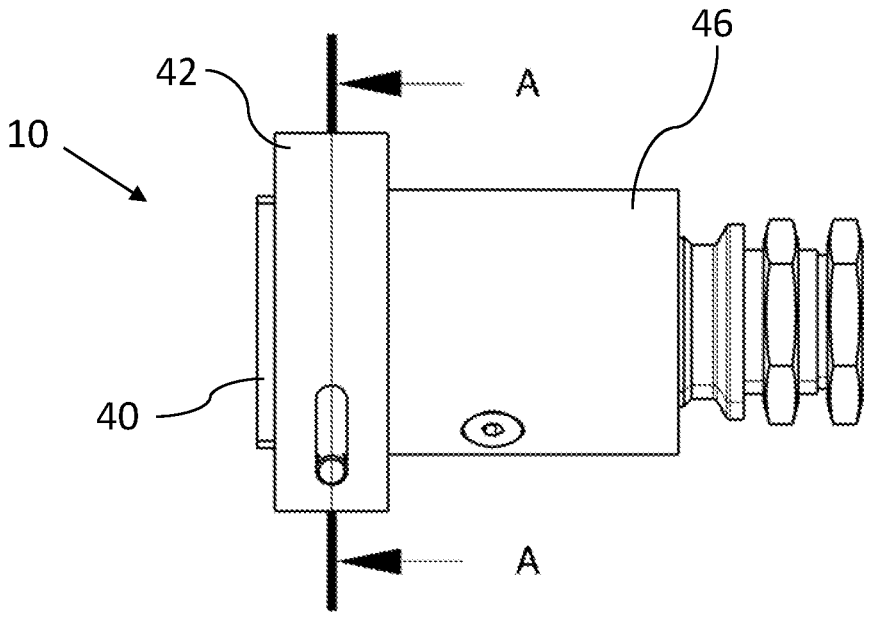
FIG. 3 is a side elevation view of the connector of FIG. 1.
Figure 4:
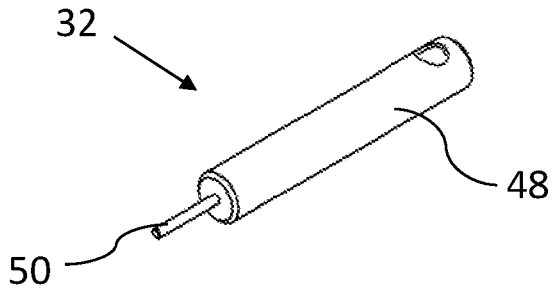
FIG. 4 is a perspective view of a release tool.
Figure 13:
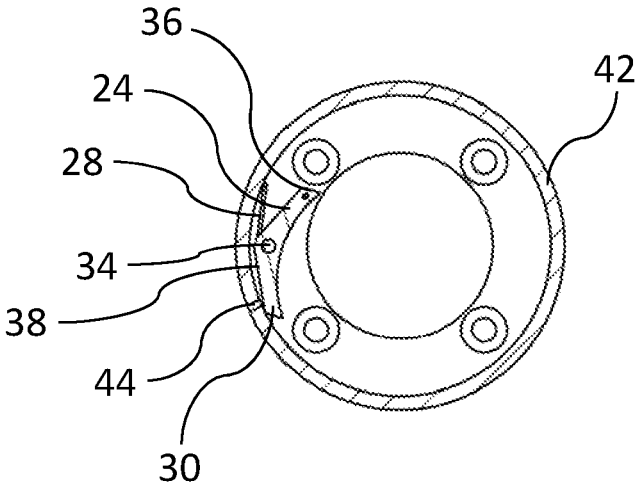
FIG. 13 is a cross sectional view of a first side of a ring shroud for the connector of FIG. 1.

Referring to FIG. 1 through FIG. 3, assembled explosion proof connector 10 is shown. First electrical connector 12 and first threaded sidewall 16 are carried on a plate 40, which is attached to a ring shroud 42 that, as shown in FIGS. 12 and 13, ratchet lock 24 internally. A release opening 44 is formed in ring shroud 42 that allows release tool 32 to access release mechanism 30. Ring shroud 42 protects release mechanism 30 from being manually operated without release tool 32. Referring to FIG. 6, a ratchet sleeve 46 is carried over second threaded sidewall 18 and is inserted into ring shroud 42. Referring to FIG. 4, release tool 32 may, for example, be a handheld tool having a handle portion 48 and an insertion portion 50 that is sized to fit within release opening 44 and to extend to release surface 38. Referring to FIG. 7, a portion of the assembly of explosion proof connector 10 is shown. The first electrical connector 12 side of explosion proof connector 10 has plate 40 connected to first threaded sidewall 16. Ring shroud 42 carrying ratchet lock 24 is inserted over first threaded sidewall 16 and connected to plate 40. The second electrical connector 14 side of explosion proof connector 10 has second threaded sidewall 18, which rotates relative to second electrical connector 14. Ratchet sleeve 46 is inserted over second threaded sidewall 18 and attached to second threaded sidewall 18 such that it is fixed relative to second threaded sidewall 18 and rotates relative to second electrical connector 14. First and second threaded sidewalls 16 and 18 can be threaded together as shown in FIG. 8 to form an electrical connection between first electrical connector 12 and second electrical connector 14. As the connection is formed, ratchet surface 26 on ratchet sleeve 46 engages with ratchet lock 24 on ring shroud 42, allowing the connection to be formed, and preventing the electrical connection from being disengaged without the activation of release mechanism 30.

In the example described above, the first and second electrical connectors 12 and 14 are typical electrical connectors that are then enclosed by an explosion proof enclosure formed by threaded sidewalls 16 and 18. These components may be found in a commercially available electrical connection. For example, explosion proof connection 10 may be formed using an existing commercially available electrical connector designed for a hazardous environment with the addition of a shroud 52 made up of ratchet sleeve 46 and ring shroud 42. Ratchet sleeve 46 may be secured over one side of a commercially available electrical connector and ring shroud 42 may be secured to the second side of the commercially available electrical connector. Ratchet sleeve 46 and ring shroud 42 are preferably formed from a non-sparking material. When the remainder of the explosion proof connector is designed to be attached to a commonly available electrical connector, the shape and sizing of the explosion proof connection 10 will preferably be designed to cooperate with various commercially available connectors. In other circumstances, first and second electrical connectors may be manufactured with ratchet lock 24 and ratchet surface 26, rather than being retrofit.

By using the ratchet lock with an electrical connection, the electrical connector may be secured for use in hazardous areas. The ratchet lock will be engaged whenever the electrical connector is engaged, such that it cannot be forgotten or ignored, and can only be released by actuating release mechanism 30. The connection may be further secured by requiring a separate release tool 32 to actuate release mechanism 30.

Figure 14:
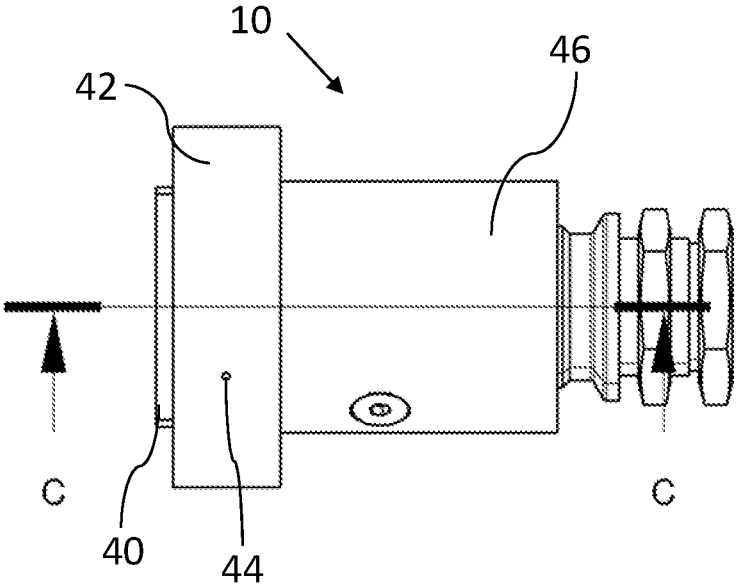
FIG. 14 is a side elevation view of the connector of FIG. 1.

The method of use of explosion proof connection 10 will now be described. Referring to FIG. 14 and FIG. 15, first and second threaded sidewalls 16 and 18 are threadably engaged to secure first and second electrical connectors 12 and 14 in electrical connection by rotating second threaded sidewall 18 relative to first threaded sidewall 16 in a first rotational direction that corresponds with first and second electrical connectors 12 and 14 moving closer together to eventually form an electrical connection. In doing so, ratchet lock 24 engages ratchet surface 26 to prevent rotation of second threaded sidewall 18 relative to first threaded sidewall 16 in a second rotational direction to disconnect first and second electrical connectors 12 and 14. As shown in FIG. 15, the electrical connection is thus formed by the engagement of first and second electrical connectors 12 and 14, held in place by the engagement of first and second threaded sidewalls 16 and 18, and locked to prevent disengagement of first and second electrical connectors 12 and 14 without being properly released. For example, when explosion proof connector 10 is used in an area having a risk of flammable or explosive gases being released, the accidental disengagement of first and second electrical connectors 12 and 14 may generate a spark that could ignite these gases. By providing both the threaded sidewalls 14 and 16 and the ratchet lock 24, the connection is protected from any disengagement without the deliberate use of release mechanism 30. When the area is safe and it is desired to disconnect the electrical connection, release mechanism 30 must then be actuated to disengage ratchet lock 24 from ratchet surface 26. This may, for example, be done manually using a release tool 32 as described above. It will be understood that other methods of releasing ratchet lock 32, as known in the art, may be used, depending on the structure of ratchet lock 24 and the needs of the user. While providing a separate release tool 32 may be desired in some circumstances, such as in hazardous environments or when a particular electrical connection is required by code, release tool 32 may also be integrated into ring shroud 42, such as by providing a push button that engages with release surface 38. Integrating release tool 32 into ring shroud 42 may be desirable when the electrical connector is used in a non-hazardous environment. When locking surface 36 is no longer engaged with ratchet surface 26, second threaded sidewall 18 is permitted to rotate in the second rotational direction, corresponding with disconnecting first and second electrical connectors 12 and 14, relative to first threaded sidewall 16. By rotating second threaded sidewall 18, first and second threaded sidewalls 16 and 18 are threadably disengaged and will release first and second electrical connectors 12 and 14 to disconnect explosion proof connector 10.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. An explosion proof connector assembly comprising:

a first electrical connector and a second electrical connector;

a first threaded sidewall that surrounds the first electrical connector and a second threaded sidewall that surrounds the second electrical connector, the first and second threaded sidewalls threadably engaging to secure the first and second electrical connectors in electrical connection, wherein either the first threaded sidewall is rotatable relative to the first electrical connector or the second threaded sidewall is rotatable relative to the second electrical connector;

a ratchet lock carried by the first threaded sidewall;

a ratchet surface carried by the second threaded sidewall, the ratchet lock releasably engaging the ratchet surface, the ratchet lock being biased toward engagement with the ratchet surface such that the ratchet lock permits rotation of the second threaded sidewall relative to the first threaded sidewall in a first rotational direction, and prevents rotation of the second threaded sidewall relative to the first threaded sidewall in a second rotational direction; and a release mechanism that disengages the ratchet lock from the ratchet surface to permit the second threaded sidewall to rotate in the second rotational direction relative to the first threaded sidewall.

2. The explosion proof connector assembly of claim 1, wherein the release mechanism is actuated by a release tool that is manually engaged with the ratchet lock to disengage the ratchet lock from the ratchet surface.

3. The explosion proof connector assembly of claim 1, wherein the ratchet lock is pivotally mounted about a pivot axis and comprises a locking surface on a first side of the pivot axis and a release surface on a second side of the pivot axis, wherein the locking surface moves away from the ratchet surface as the release surface is moved toward the ratchet surface.

4. The explosion proof connector assembly of claim 1, wherein the first threaded sidewall is an externally threaded sidewall, and the second threaded sidewall is an internally threaded sidewall.

5. The explosion proof connector assembly of claim 4, wherein the second threaded sidewall is rotatable relative to the second electrical connector.

6. A lock for an electrical connection formed by first and second electrical connectors, the first and second electrical connectors having complementary threaded sidewalls that threadably engage, the lock comprising: a first sleeve having an attachment that attaches to the first electrical connector, the first sleeve carrying a ratchet lock on an interior surface, the interior surface defining a cavity;

a second sleeve having an attachment that attaches to the second electrical connector, the second sleeve having a ratchet surface on an exterior surface at a first end of the second sleeve, the first end of the second sleeve being sized to fit within the cavity of the first sleeve;

wherein, when the first and second electrical connectors are threadably engaged, the first end of the second sleeve is inserted into the cavity of the first sleeve and the ratchet lock releasably engages the ratchet surface, the ratchet lock being biased toward engagement with the ratchet surface such that the ratchet lock permits the first and second electrical connectors to threadably engage and prevents the first and second electrical connectors from being threadably released; and a release mechanism that disengages the ratchet lock from the ratchet surface to permit the first and second electrical connectors to be threadably released.

7. The lock of claim 6, wherein the release mechanism is actuated by a release tool that is manually engaged with the ratchet lock to disengage the ratchet lock from the ratchet surface.

8. The lock of claim 6, wherein the ratchet lock is pivotally mounted about a pivot axis and comprises a locking surface on a first side of the pivot axis and a release surface on a second side of the pivot axis, wherein the locking surface moves away from the ratchet surface as the release surface is moved toward the ratchet surface.

9. A method of forming an explosion proof connection, the method comprising the steps of:

providing an explosion proof connector comprising:

a first electrical connector and a second electrical connector;

a first threaded sidewall that surrounds the first electrical connector and a second threaded sidewall that surrounds the second electrical connector, wherein either the first threaded sidewall is rotatable relative to the first electrical connector or the second threaded sidewall is rotatable relative to the second electrical connector;

a ratchet lock carried by the first threaded sidewall and pivotally mounted about a pivot axis, the ratchet lock comprising a locking surface on a first side of the pivot axis and a release surface on a second side of the pivot axis;

a ratchet surface carried by the second threaded sidewall, the ratchet lock being biased toward engagement with the ratchet surface, and wherein the locking surface of the ratchet lock moves away from the ratchet surface as the release surface is moved toward the ratchet surface; and a release mechanism; and threadably engaging the first and second threaded sidewalk to secure the first and second electrical connectors in electrical connection by rotating the second threaded sidewall relative to the first threaded sidewall in a first rotational direction, the ratchet lock engaging the ratchet surface to prevent rotation of the second threaded sidewall relative to the first threaded sidewall in a second rotational direction.

10. The method of claim 9, further comprising the steps of:

actuating the release mechanism to disengage the ratchet lock from the ratchet surface to permit the second threaded sidewall to rotate in the second rotational direction relative to the first threaded sidewall;

threadably disengaging the first and second threaded sidewalk to release the first and second electrical connectors by rotating the second threaded sidewall relative to the first threaded sidewall in the second rotational direction; and disconnecting the explosion proof connection.

11. The method of claim 9, wherein the second threaded sidewall is rotatable relative to the second electrical connector.

12. The method of claim 9, wherein actuating the release mechanism comprises manually engaging a release tool with the ratchet lock to disengage the ratchet lock from the ratchet surface.

13. The method of claim 12, wherein the first threaded sidewall is an externally threaded sidewall, and the second threaded sidewall is an internally threaded sidewall.

* * * * *